United States Patent [19]

Ehrens et al.

[11] 3,965,882

[45] June 29, 1976

[54] SELF-PROJECTING ELASTIC TYPE PROJECTING DEVICE

[75] Inventors: Henry Ehrens, Bayside; Frank Nonnenmacher, Brooklyn, both of N.Y.

[73] Assignee: Allenwood Sports, Inc., Allenwood, N.J.

[22] Filed: Apr. 25, 1974

[21] Appl. No.: 463,884

[52] U.S. Cl. ..... 124/18; 273/106.5 B; 273/106.5 C; 124/80; 273/106.5 A

[51] Int. Cl.[2] ..... F41B 7/02

[58] Field of Search ..... 124/20 R, 20 A, 20 B, 124/30 R, 17, 18; 273/106.5 R, 106.5 B, 106.5 C, 106.5 A

[56] References Cited

UNITED STATES PATENTS

| | | | |
|---|---|---|---|
| 101,382 | 3/1870 | Robinson | 124/18 |
| 1,626,892 | 5/1927 | Tidwell | 124/18 |
| 1,751,488 | 3/1930 | Meyer | 124/18 |
| 2,672,857 | 3/1954 | Gauthier | 124/20 R |
| 2,692,593 | 10/1954 | Flores | 124/18 |
| 3,494,346 | 2/1970 | Yount et al. | 124/20 R |

FOREIGN PATENTS OR APPLICATIONS

| | | | |
|---|---|---|---|
| 32,359 | 5/1923 | Denmark | 124/18 |
| 615,159 | 1/1949 | United Kingdom | 273/106.5 A |

*Primary Examiner*—Richard C. Pinkham
*Assistant Examiner*—William R. Browne
*Attorney, Agent, or Firm*—Yuter & Rosen

[57] ABSTRACT

A self-powered dart system is disclosed which comprises a self-powered dart and a launcher for launching the dart. The self-powered dart consists of a stretchable elongated body, such as a rubber tube, having a weighted head at one end and a launching connection at the other end. The launcher consists of a handle having a pivotable launching post mounted in a bent top portion of the handle. The self-powered dart is connected to the launching post, for example by positioning the post in the end opening of the rubber tube dart body. The head is drawn backwards (like the tail of an arrow in archery) with the launching post in a vertical position to temporarily engage the dart tail so as to permit stretching of the dart body. When the head is released it snaps across the top of the handle, changing from pointing backwards to pointing forwards, rotating the launching post to the horizontal position to permit the release of the dart body without imparting undesirable side forces. The weighted head causes the dart body to travel behind it imparting aerodynamic stability which is enhanced in the rubber tube mode by longitudinal slits. The weighted head may be pointed for target shooting, rounded for routing pests, arrowhead shaped for hunting, or in the form of a suction cup when used as a toy. In a more powerful version, an arm brace extends rearward from the bottom of the handle and terminates in a cushioned arm rest adapted to be positioned over the forearm so as to help brace the handle in a vertical position.

6 Claims, 12 Drawing Figures

FIG. 1
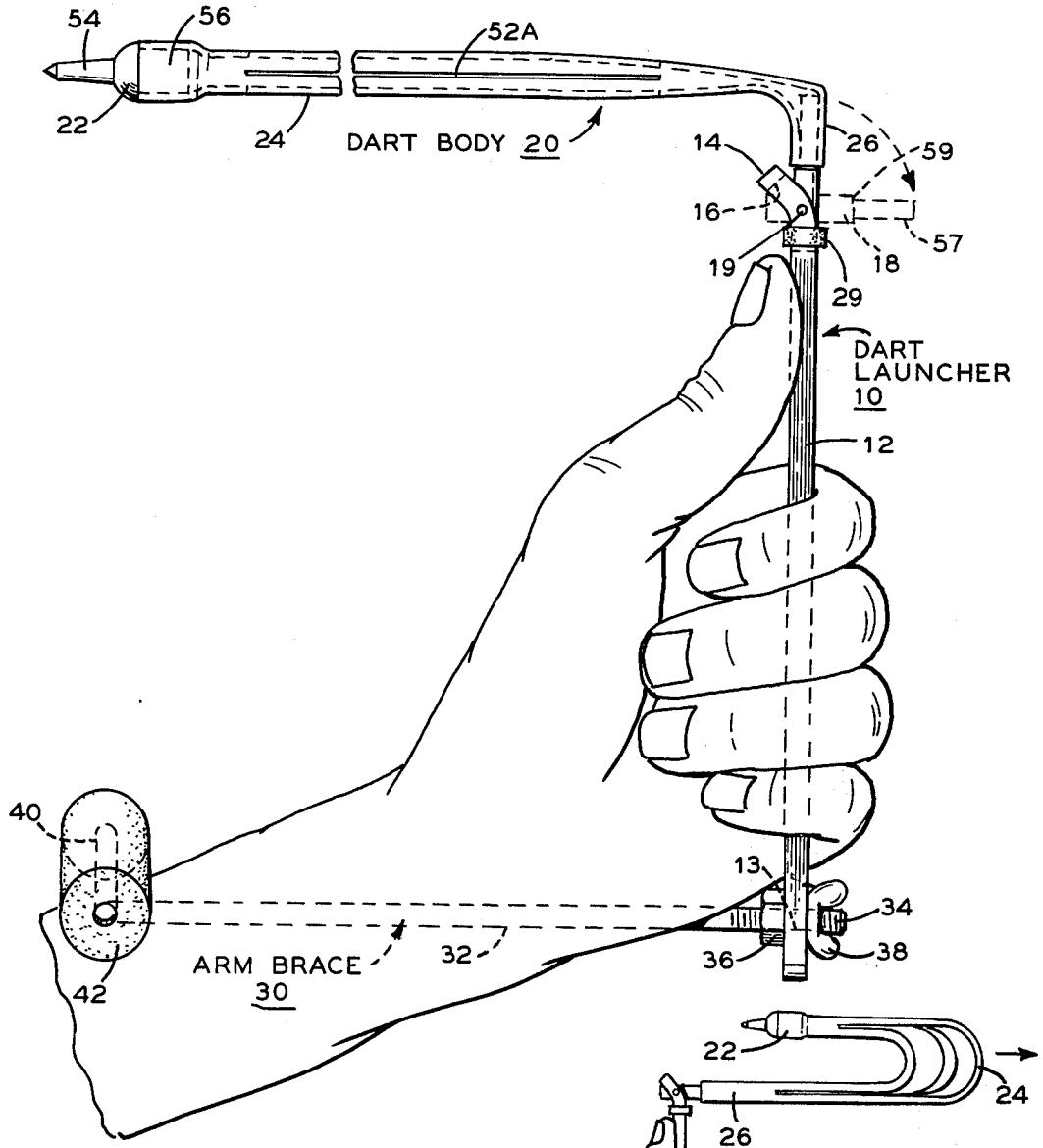
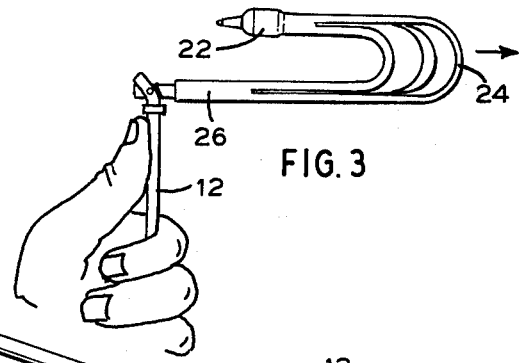
FIG. 3
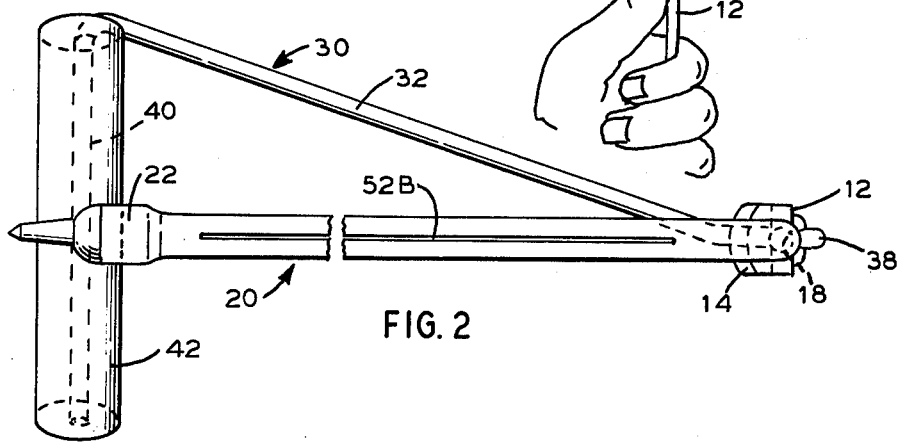
FIG. 2

SELF-PROJECTING ELASTIC TYPE PROJECTING DEVICE

BACKGROUND OF THE INVENTION

The well-known dart consists of a generally cylindrical rigid body with a point at one end and guide vanes at the other end. Darts are usually thrown at a target at a relatively short range; in the order of five yards. An arrow is a form of dart which is projected a much longer range by means of a bow. The sport of shooting with a bow and arrows, archery, is ancient both for target shooting and hunting, and millions of people annually take part in archery. However, bows and arrows are fairly cumbersome and can be quite expensive.

BRIEF SUMMARY OF THE INVENTION

The invention relates to the sport of launching darts at a target and more particularly to a system for launching darts at a range between the relatively short range of the conventional dart and the relatively long range of an arrow launched by a bow.

The genesis of the invention can be found in the game of propelling a rubber band through the air by looping one end over a finger tip and pulling back and then releasing the other end. The rubber band will fly through the air a short distance but with generally poor accuracy. A more accurate device is a slingshot made by fastening an elastic band on each prong of a forked stick and connecting the other ends of the elastic band by a pouch. A stone or similar projectile is held in the pouch which is then pulled back and released projecting the stone a substantial distance and with some degree of accuracy. But slingshot shooting has not grown into a popular sport like archery, perhaps because the projectile bounces off a target so that relative accuracy is hard to measure.

Notwithstanding that the sport of archery is ancient and that dart games and slingshots have been known for a very long time, no one (to applicants' knowledge) has previously combined the fun and compactness of a dart game or slingshot with the accuracy and much longer range of the bow and arrow, until applicants invented their self-powered dart system.

A general object of the invention is to provide a new sport which combines the fun of dart throwing with the much longer range of archery.

A more specific object of the invention is to provide a system for projecting darts at a range and with a velocity sufficient for hunting small game, and even larger game with the more powerful embodiments of the invention.

Still another object of the invention is to provide a target shooting game with some of the challenges of archery but at a lower cost.

A further object of the invention is to provide a shooting system which is light and compact so that it can readily be carried in one's pocket.

Still another object of the invention is to provide a safe target shooting toy with a range greater than the usual dart but without the dangers of a pointed head.

Briefly, applicants' invention is a self-powered dart system which comprises a self-powered dart and a dart launcher. The dart launcher consists of a handle having a launching mechanism at the top. The self-powered dart consists of a stretchable elongated body having a weighted head at one end and a launching connection at the other end. In the best mode of the invention, the dart body is a rubber tube with the weighted head permanently positioned at one end. The opening in the other end is the launching connection which is positioned over a pivotable post at the top of the handle. Then the head is pulled back, like the tail of an arrow in a bow, and the dart body stretched and aimed. The head is then released and snaps over the handle, changes to the forward direction, pulls the dart body tail from the launching mechanism and, with the dart body providing aerodynamic stability, proceeds toward the target. Ranges of about 50 yards may readily be attained with an accuracy that can approach that of a bow and arrow.

In a more powerful embodiment of the invention, an arm brace is connected to the lower end of the launching handle and comprises a support bar connected at right angles to the handle and extending rearward toward a cushioned arm rest adapted to be positioned over the forearm so as to brace the handle in a vertical position when more powerful stretchable dart bodies are used for increased range and velocity.

The weighted dart head may be pointed like a regular dart, rounded for routing small pests, shaped like an arrowhead for hunting, or in the form of a suction cup for low power toys. The elongated stretchable body is preferably in the form of a long rubber tube with four parallel longitudinal slits equally spaced around the rubber tube. However, it may be a molded rubber or stretchable plastic band, in which case the launching connection is an opening at the tail end.

The term "self-powered" is meant to cover a dart in which the dart body itself provides the projection power, rather than the throwing arm or an external source such as a spring.

Other objects and features of the invention, as well as other variations of the basic concepts, will be apparent from a consideration of the following detailed description of the best mode of the invention.

BRIEF DESCRIPTION OF THE DRAWINGS

FIG. 1 is an elevational view of the self-powered dart system with the weighted head of the stretchable elongated dart body (partly broken away to illustrate its entire length) drawn backwards (by a right hand, not shown) with the launcher handle held in the left hand in the vertical operating position, aided by the arm brace which is detachably connected to the lower end of the launcher handle.

FIG. 2 is a plan view of the self-powered dart body, launcher handle and arm brace of FIG. 1.

FIG. 3 illustrates the shape of the dart body immediately after release of the head but before the head has completely changed direction so as to pull the tail of the dart body from the launching post of the launcher.

DESCRIPTION AND OPERATION OF THE BEST MODE OF THE INVENTION

Figure 5:
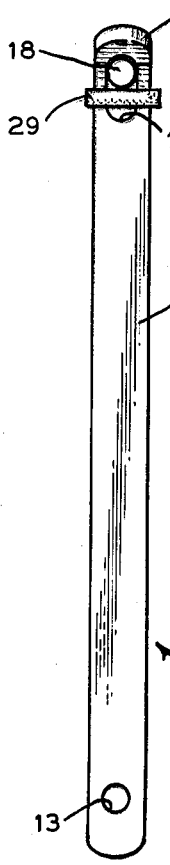
FIG. 5 is a front elevational view of the launcher handle showing the elongated slot in which the pivotable launching post is mounted.
Figure 6:
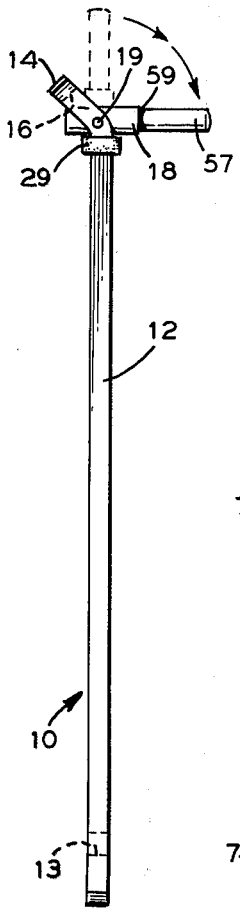
FIG. 6 is a side view of FIG. 5 showing the movement of the launching post from the drawn position to the released position.
Figures 7A, 7B:
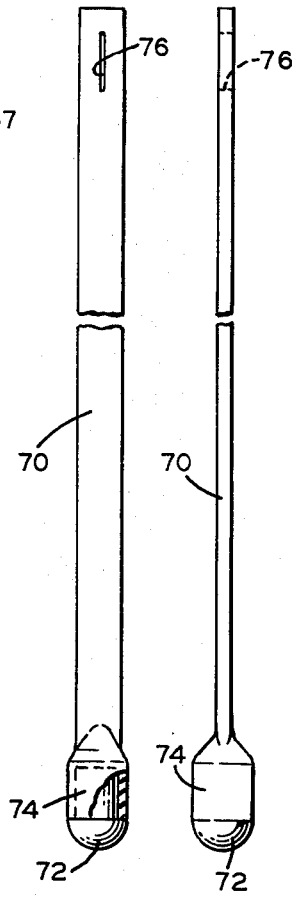
FIG. 7A is a plan view of a stretchable elongated dart body in the form of a molded band, in accordance with another embodiment of the invention.
FIG. 7B is a side view of the molded band embodiment.
Figure 8:
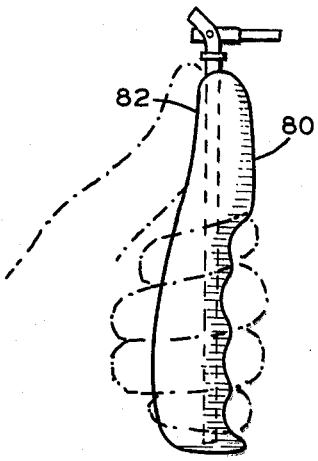
FIG. 8 shows an alternative embodiment of the handle which is shaped like a pistol grip.

FIGS. 1–6 and 9 generally illustrate the best mode of the invention. Alternative embodiments are shown in FIGS. 7 and 8.

Referring to FIGS. 1 and 2, the self-powered dart system generally comprises a dart launcher 10 and an elongated stretchable dart body 20. Dart launcher 10 consists of a handle 12 having a bent top portion 14 with an elongated slot 16 (also see FIG. 5). A pivotable launching post 18 is mounted in slot 16 on a pin 19. Rubber band 29 tightly encircles the upper end of the handle 12 and is positioned at the bent portion 14 in abutment with the rear end of the launching post 18. Rubber band 29 functions to urge launching post 18 into a horizontal position (see FIGS. 5 and 6).

Dart body 20 consists of a weighted head 22, an elongated stretchable body portion 24 and a launching connection 26 at its tail.

Detachably connected at a right angle to the lower end of the handle 12 (FIG. 1) is arm brace 30 consisting of a support bar 32 having a threaded front portion positioned in an opening 13 in the lower end of handle 12 with a nut 36 on one side of the handle 12. A wing nut 38 is on the other side and is adapted to be tightened to rigidly connect arm brace 30 to handle 12. Support arm 32 is bent at about a 30° angle with the front plane of the handle 12 (FIG. 2) and projects rearward and then bends into a plane parallel to the front plane of handle 12. An armrest 42 in the form of a sponge rubber tube is positioned on the armrest portion 40 of the support arm 32. The armrest portion 40 is slightly curved convex downward to fit the forearm of the user.

Body portion 24 (FIG. 1) comprises a rubber tube having four elongated slits 52 intermediate its ends, parallel to each other and spaced equidistant around the periphery of the rubber tube. Slit 52A is shown in FIG. 1 and slit 52B in FIG. 2. While more slits 52 can be provided, or even none, experiments have demonstrated that four slits 52 are preferred for aerodynamic stability. The slits 52 also increase the stretching capability of the body portion 24.

Head 22 comprises heavy metal such as hardened steel having a point 54 and a reduced cylindrical portion 56 (shown in dotted outline). FIG. 9A shows a similar pointed head partly broken away to show the reduced cylindrical portion 56. The front end of body portion 24 is stretched around portion 56 to tightly engage the head 22. Launching connection 26 (FIGS. 1 and 3) comprises the opening in the end of the rubber tube.

In operation, the opening 26 in the end of the rubber tube body portion 20 is positioned on the launching post 18 over a reduced section 57 and abuts against a shoulder 59. The relationship between the diameter of the launching connection opening 26 and the outer diameter of the reduced section 57 of the launching post 18 is such as to provide a loose but not a sloppy fit. Handle 12 is grasped as shown in FIG. 1 with the armrest portion 40 braced against the upper portion of the forearm. Head 22 is grasped between the thumb and forefinger of the other hand (like the end of an arrow), the handle-holding arm outstretched in front (like holding a bow) and the head 22 drawn back and held close to the jaw bone. Aiming is done as in archery and improved accuracy comes with practice. The head 22 is let slip from between the thumb and forefinger causing the head 22 to snap forward, over the top of handle 12 (FIG. 3). Initially, launching post 18 is in the vertical position (shown in dotted outline in FIG. 6), due to pulling the dart body 20 backwards. If the handle is tilted slightly forward it helps keep launching connection 26 on the launching post 18. When the launching post 18 is in the vertical position, it presses against rubber band 29, distending it. Upon release of head 22, rubber band 29 urges the launching post 18 into the horizontal position (FIG. 3) so that the head 22 will not strike it as it passes over the top handle 12. Moreover, launching connection 26 will readily slide off the horizontal launching post 18 as the dart body fully extends into its forward in-flight position, thus preventing any undesirable side forces from being exerted on the dart body 20.

Figure 4:
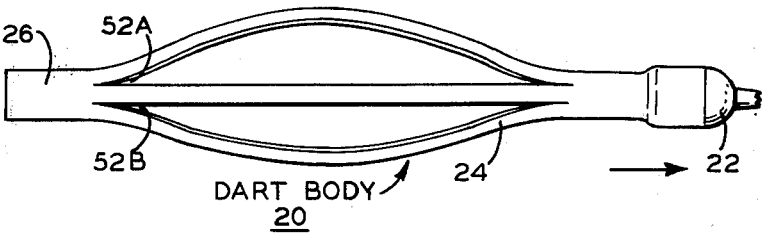
FIG. 4 (sheet 2, lower right) shows the dart body in flight after leaving the launcher, with the dart body slightly bulged to aid aerodynamic stability.

FIG. 4 illustrates the dart body 20 in flight. Experiments have indicated that the dart body tends to bulge out initially due to the slits 52 (FIGS. 1 and 2) and it is believed that the bulging action improves the aerodynamic stability of the dart body in flight. The tail acts as a brake to keep the weighted head in front, and the tail tends to "fishtail", or move from side to side, to enhance stability. It should be noted, however, that the dart body 20 moves so rapidly that it is difficult to determine with the naked eye its exact dynamics, and limited resources have prevented the use of high speed photographic techniques to determine what actually occurs in flight.

An exemplary dart body 20 which performed extremely well consisted of an 8 inch long pure gum rubber latex tube having an inner diameter of one-quarter inch and an outer diameter of three-eighths inch, with a weight of 1 ounce. The slits 52 were 5¾ inches long. The head 22 was made of hardened steel and had a one-half inch outer diameter with the reduced portion 56 having an outer diameter one-eighth inch less and weighed 2 ounces. Thus, the entire dart body 20 weighed about 3 ounces. When drawn to a length of 30 inches it exerted a force of 18 pounds. When the aim angle at launch was 0° (parallel to the ground), its most effective range was 72 feet. An aim angle of 10° above the horizontal increased the effective range to 108 feet; 20° to 141 feet; 30° to 148 feet; and 40° to 159 feet.

Figure 9B:
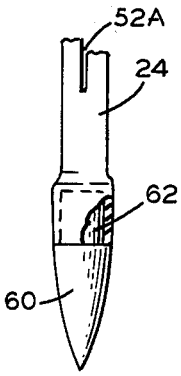
FIGS. 9A–9C illustrate alternative heads of the self-powered dart body.
Figure 9A:
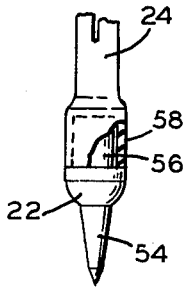

FIG. 9B shows an alternative head in the shape of an arrowhead 60 made of hardened steel. A cylindrical section 62 of reduced diameter permits the open end of the elongated stretchable body portion 24 to be tightly stretched about the cylindrical section 62 so that the arrowhead 60 remains connected to the body portion 24 during normal usage. Arrowhead 60 would be used for the most powerful versions of the self-powered dart, in which case arm brace 30 is recommended.

Figure 9C:
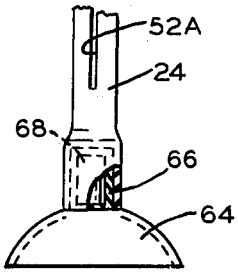

FIG. 9C shows a rubber suction cup head 64 having a rearwardly extending section 66 having an opening in which is mounted a weight 68. A dart body 20 using the suction cup head 64 would normally be used without arm brace 30, although for small children the arm brace 30 is helpful. The suction cup 64 is adapted to stick to a flat target generally perpendicular to the ground (not shown).

ALTERNATIVE EMBODIMENTS OF THE INVENTION

FIG. 7 shows an alternative embodiment of the invention in which the dart body portion 70 is a flat solid band made of stretchable plastic or rubber, rather than a hollow tube. The weighted head 72 is mounted into a molded cylindrical opening 74 at the front of the body portion 70. The head 72 is shown rounded rather than pointed to illustrate still another embodiment of the head which is useful for routing small pests. A launching connection 76 in the tail of the body portion 70 comprises a short slit which can readily be connected to the launching post 18 (FIGS. 5 and 6). Alternatively, the launching connection may be molded into a solid rod and the launching post constructed in the form of a hollow cylinder to receive the rod.

FIG. 8 shows an alternative embodiment to the dart launcher 10 in FIG. 1. The construction is similar except that handle 12 (FIG. 5) is mounted in a wooden or plastic pistol grip 80 having a flattened portion 82 on which the thumb may be rested.

Other embodiments of the self-powered dart invention employing the same basic concepts will no doubt be thought of by others, which should be described by, or the equivalent of, applicants' invention as defined by the following claims.

What is claimed is:

1. A self-powered dart system comprising a self-powered dart and a dart launcher for launching said self-powered dart, A. said dart launcher comprising
   1. a handle, and
   2. a launching post pivotally connected to one end of said handle;

B. said self-powered dart comprising
   1. a stretchable elongated flexible tube having a plurality of peripherally-spaced longitudinal slits extending substantially its full length,
   2. a weighted head positioned at one end of the tube, and
   3. a means at the other end of the tube for detachably receiving and holding in a telescoping fashion the launching post of said dart launcher whereby when the tube is pulled to a cocked position the post will be prevented from pivoting rearwardly by a stop and when the dart is released the post will pivot forwardly and permit the dart to be detached from the post.

2. A self-powered dart system according to claim 1 wherein said stretchable elongated flexible tube has a concentric opening at said one end and said weighted head is mounted in said concentric opening, and said launching post has a reduced cylindrical portion for insertion into the means at the other end of said tube.

3. A self-powered dart system according to claim 2 wherein said stretchable elongated flexible tube is a rubber tube having four parallel and substantially coterminous elongated slits longitudinally positioned between the ends of said rubber tube and equally peripherally-spaced from each other.

4. A self-powered dart system according to claim 2 wherein said head has a cylindrical portion having an outside diameter larger than the inside diameter of said stretchable elongated tube so that said head is frictionally held within the end of said tube.

5. A self-powered dart system according to claim 1 further comprising a resilient band encircling the upper end of said handle and abutting the lower side of said pivotable launching post to urge said launching post into a position about ninety degrees to said handle.

6. A self-powered dart system comprising a self-powered dart and a dart launcher for launching said self-powered dart, A. said dart launcher comprising
   1. a handle,
   2. a launching post pivotally connected to one end of said handle, and
   3. a stop on said handle;

B. said self-powered dart comprising
   1. a stretchable elongated flexible tube,
   2. a means at the end of the tube for detachably receiving and holding in a telescoping fashion the launching post of said dart launcher, whereby when the tube is pulled to a cocked position the post will be prevented from pivoting rearwardly by said stop and when the dart is released the post will pivot forwardly and permit the dart to be detached from the post.

* * * * *